US006189501B1

(12) United States Patent
Fujii et al.

(10) Patent No.: US 6,189,501 B1
(45) Date of Patent: Feb. 20, 2001

(54) LUBRICATING APPARATUS FOR ENGINE

(75) Inventors: Kenichi Fujii; Jiro Saiga, both of Hamamatsu (JP)

(73) Assignee: Suzuki Kabushiki Kaisha, Hamamatsu (JP)

( * ) Notice: Under 35 U.S.C. 154(b), the term of this patent shall be extended for 0 days.

(21) Appl. No.: 09/345,445

(22) Filed: Jul. 1, 1999

(30) Foreign Application Priority Data

Jul. 3, 1998 (JP) ..... 10-189021

(51) Int. Cl.[7] ..... F02F 7/00; F01M 11/03; F01M 1/02

(52) U.S. Cl. ..... 123/195 C; 123/196 W

(58) Field of Search ..... 123/196 R, 196 W, 123/195 C, 195 HC; 184/6.18; 440/900

(56) References Cited

U.S. PATENT DOCUMENTS 5,975,970 * 11/1999 Daikoku ..... 440/88

6,012,956 * 1/2000 Mishima et al. ..... 440/88

* cited by examiner

*Primary Examiner*—Andrew M. Dolinar
*Assistant Examiner*—Hai Huynh
(74) *Attorney, Agent, or Firm*—Finnegan, Henderson, Farabow, Garrett, & Dunner, L.L.P.

(57) ABSTRACT

A lubricating apparatus for an engine of an outboard motor comprises an oil pan disposed in a lower portion of an engine in a mounted state thereof and provided with an oil accumulating tank, an oil strainer for straining an oil accumulated in the oil accumulating tank, an oil pump for supplying strained oil to an inside portion of the engine, the oil strainer and the oil pump being mounted to a structural member such as pump case disposed above the oil pan so as to be connected to each other, and an oil suction pipe extending from the oil strainer to a bottom portion of the oil accumulating tank.

7 Claims, 7 Drawing Sheets

LUBRICATING APPARATUS FOR ENGINE

BACKGROUND OF THE INVENTION

The present invention relates to a lubricating apparatus for an engine or engine unit of, for example, an outboard motor, incorporating an oil pump for pumping oil accumulated in an oil pan disposed to a lower portion of the engine to supply an oil to the inside portion of the engine.

FIG. 7 is a vertical sectional view showing a usual example of a lubricating apparatus for an outboard motor. A lubricating apparatus 100 is provided with an oil pan 101 disposed in the lower portion of an engine (not shown) in a state of an outboard motor mounted to a hull, for example. An oil strainer section 104 is disposed at a lowermost end of a metallic oil suction pipe 103 extending from an oil pump (not shown) disposed in the lower portion of the engine to the bottom of the oil pan 101, i.e. an oil accumulating tank 102.

When the oil pump of the lubricating apparatus 100 is operated owning to the operation of the engine, the oil in the oil accumulating tank 102 is strained or filtered by the oil strainer section 104. The oil then passes through the oil suction pipe 103 and is sucked by the oil pump so as to be, under pressure, supplied to the inside portion of the engine.

The lubricating apparatus 100 structured as described above incorporates the oil strainer section 104 having a large diameter and disposed in the bottom portion of the oil accumulating tank 102. Therefore, a sufficiently large clearance must be provided between the oil strainer section 104 and an inner wall 112 of the oil pan 101, as shown in FIG. 8. Therefore, the area of the bottom of the oil accumulating tank 102 has been enlarged.

An outboard motor designed such that side cross sectional area of the lower portion of the oil pan 101 is reduced. However, in such design, there occurs a difficulty in enlarging the area of the bottom of the oil accumulating tank 102. Therefore, the oil strainer section 104 cannot easily be mounted. When the oil pan 101 is mounted to or removed from the engine unit, there is a fear that the oil strainer section 104 collides with the oil pan 101 and is hence damaged.

SUMMARY OF THE INVENTION

A primary object of the present invention is to substantially eliminate defects or drawbacks encountered in the prior art mentioned above and to provide a lubricating apparatus for an engine which is capable of mounting an oil strainer section with no necessity of enlarging the area of the bottom of an oil accumulating tank in an oil pan and protecting the oil strainer section from being damaged when the oil pan is mounted or removed.

Another object of the present invention is to provide an lubricating apparatus for an engine with which maintenance of the oil strainer section and the oil pump can easily be performed.

A further object of the present invention is to provide a lubricating apparatus for an engine which permits satisfactory sucking of oil into the oil pump.

A still further object of the present invention is to provide a lubricating apparatus for an engine with which the oil pan can easily and smoothly be mounted.

These and other objects can be achieved according to the present invention by providing, in one aspect, a lubricating apparatus for an engine comprising:

an oil pan disposed in a lower portion of an engine in a mounted state thereof and provided with an oil accumulating tank;

an oil strainer for straining an oil accumulated in the oil accumulating tank;

an oil pump for supplying strained oil to an inside portion of the engine, the oil strainer and the oil pump being mounted to a structural member disposed above the oil pan so as to be connected to each other; and an oil suction pipe extending from the oil strainer to a bottom portion of the oil accumulating tank.

In a preferred embodiment in this aspect, the oil strainer includes a cover therefor and the oil pump includes a cover therefor, the covers of the oil strainer and the oil pump being provided for a same side of the structural member to which the oil strainer and the oil pump are mounted.

The oil suction pipe has a lower opened end which is obliquely cut. The oil suction pipe is formed of a flexible hose member.

The structural member is a pump case in which the oil pump is accommodated.

The oil strainer is disposed in an oil strainer chamber so as to divide the oil strainer chamber into an upper clean side and a lower dirty side, the upper clean side being communicated with a suction port of the oil pump through an oil passage formed in the oil pump case and the lower dirty side being communicated with the oil suction pipe. The oil strainer has a net-shaped structure.

In another aspect of the present invention, there is provided a lubricating apparatus for an engine comprising:

an oil pan disposed in a lower portion of an engine in a mounted state thereof and provided with an oil accumulating tank;

an oil strainer device for straining an oil accumulated in the oil accumulating tank;

an oil pump disposed on a side of the engine for supplying strained oil to an inside portion of the engine, the oil strainer device comprising a strainer housing mounted to a bottom portion of the oil accumulating tank, an oil strainer section provided for an opening of the strainer housing and an oil passage formed in the oil pan so as to establish a communication between the oil pump and an inside portion of the strainer housing.

According to the structures in both the aspects of the present invention mentioned above, since the oil strainer section is disposed above the oil pan, the oil strainer section can be mounted with no necessity of enlarging the area of the bottom of the oil accumulating tank in the oil pan and complicating the internal structure of the oil pan. Since the oil strainer section does not collide with the oil pan when the oil pan is mounted or removed, the oil strainer section can be protected from being damaged. Furthermore, the simultaneous maintenance of the oil pump and the oil strainer section is permitted. Therefore, the maintenance of the lubricating apparatus can considerably easily be performed. Since the area of the opening of the lower portion of the oil suction pipe can be enlarged, the oil suction pipe cannot easily be clogged. Thus, oil can satisfactorily smoothly be sucked into the oil pump.

Furthermore, since the oil suction pipe downwards extending from the oil strainer section can easily be inserted into the oil accumulating tank when the oil pan is mounted, the oil pan can easily be mounted.

Furthermore, since the oil strainer section is integrally provided with the bottom of the oil accumulating tank, a necessity of providing a clearance between the inner wall of the oil pan (the oil accumulating tank) and the oil strainer section can be eliminated. Therefore, the oil strainer section can be mounted without a necessity of enlarging the area of the bottom of the oil accumulating tank. Moreover, the oil strainer section can be protected from damage when the oil pan is mounted or removed.

The nature and further characteristic features of the present invention will be made more clear from the following descriptions made with reference to the accompanying drawings.

DESCRIPTION OF THE PREFERRED EMBODIMENTS

Figure 1:
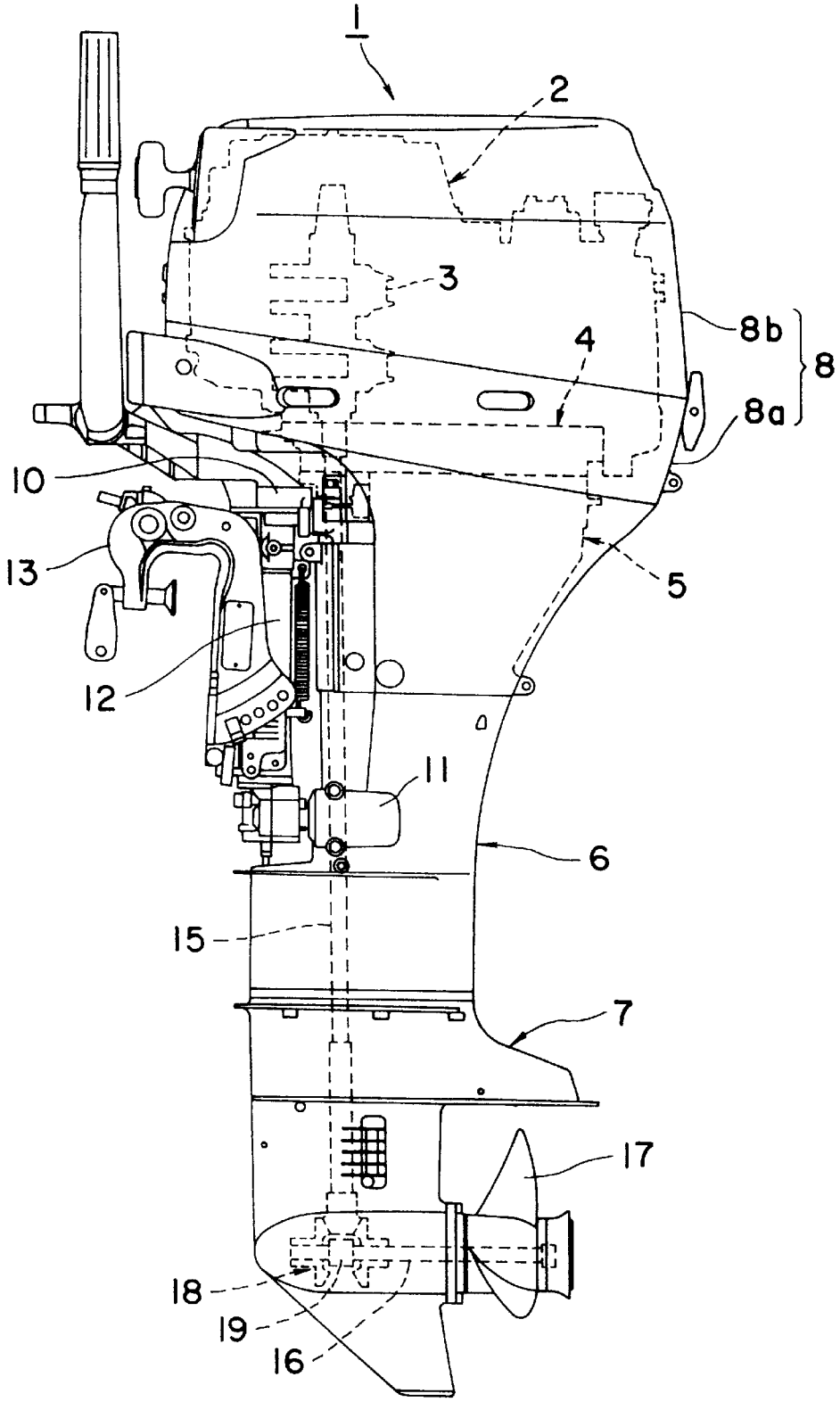
FIG. 1 is a left-hand side view showing an example of an engine of, for example, an outboard motor, to which a lubricating apparatus according to the present invention is applied.

Embodiments of the present invention will be described hereunder with reference to the drawings. FIG. 1 is a left-hand side view showing an example of an outboard motor to which a lubricating apparatus according to the present invention is applicable.

An engine or engine unit 2 mounted on the upper portion of the outboard motor 1 is, for example, an in-line, two-cylinder, four-stroke-cycle engine. The engine 2 is vertically mounted such that a crank shaft 3 thereof is disposed perpendicularly in a state of the engine being mounted to an outboard motor which is mounted to a hull, for example. An oil pan 5 is, through a plate-like oil pump case 4, secured to the lower portion of the engine 2. A drive housing 6 and a gear housing 7 are sequentially secured to the lower portion of the oil pan 5.

The engine 2, the oil pump case 4 and the oil pan 5 are covered with an engine cover 8 which is separable in the vertical direction. The engine cover 8 includes a lower cover section 8*a* secured across the oil pump case 4 and the oil pan 5 and an upper cover section 8*b* detachably joined to the lower cover section 8*a*. When maintenance or inspection of the engine 2 is performed, the upper cover section 8*b* is removed.

Mount members 10 and 11 are provided for the front ends of the corresponding oil pan 5 and drive housing 6, respectively. Upper and lower ends of a pilot shaft 12 are secured to the upper and lower mount members 10 and 11. The pilot shaft 12 is supported by a clamp bracket 13 such that horizontal rotation thereof is permitted. The clamp bracket 13 is secured to the stern of a hull.

A drive shaft 15 is rotatively and integrally joined to the lower end of the crank shaft 3 of the engine 2 and extends downward therefrom. The drive shaft 15 penetrates the inside portions of the oil pump case 4, the oil pan 5 and the drive housing 6 to reach the inside portion of the gear housing 7. A propeller shaft 16 is rotatively supported in the gear housing 7 in a horizontal direction, i.e. longitudinal direction. A screw propeller 17 is rotatively and integrally joined to the rear end of the propeller shaft 16.

A bevel gear mechanism 18 and a clutch shifter 19 are disposed in a portion in which the drive shaft 15 intersects the propeller shaft 16. Thus, the rotation of the drive shaft 15 can be transmitted to the propeller shaft 16 through the bevel gear mechanism 18. As a result, the screw propeller 17 is rotated thereby to generate propelling force. The clutch shifter 19 shifts the rotational direction of the drive shaft 15, which is always rotated in a predetermined direction, so that the rotation is transmitted to the propeller shaft 16. Thus, going ahead or going astern operation of the outboard motor 1, i.e. the hull, is selected.

Next, with reference to FIGS. 2 to 5, the oil pan is formed in shape of container opened upward. Lubrication or lubricating oil O for lubricating the engine 2 is accumulated in an oil accumulating tank 21 in the oil pan 5. An exhaust-gas discharge passage 22 extending vertically, a cooling-water supply passage 23 and a cooling-water discharge passage 24 formed to surround the exhaust-gas discharge passage 22 are formed on either side (for example, on the right-hand side of the movement) of the oil accumulating tank 21. On the other hand, an exhaust-gas opening 25 and cooling-water openings 26 and 27 corresponding to the exhaust-gas discharge passage 22, the cooling-water supply passage 23 and the cooling-water discharge passage 24 of the oil pan 5 are provided for the oil pump case 4.

Figure 3:
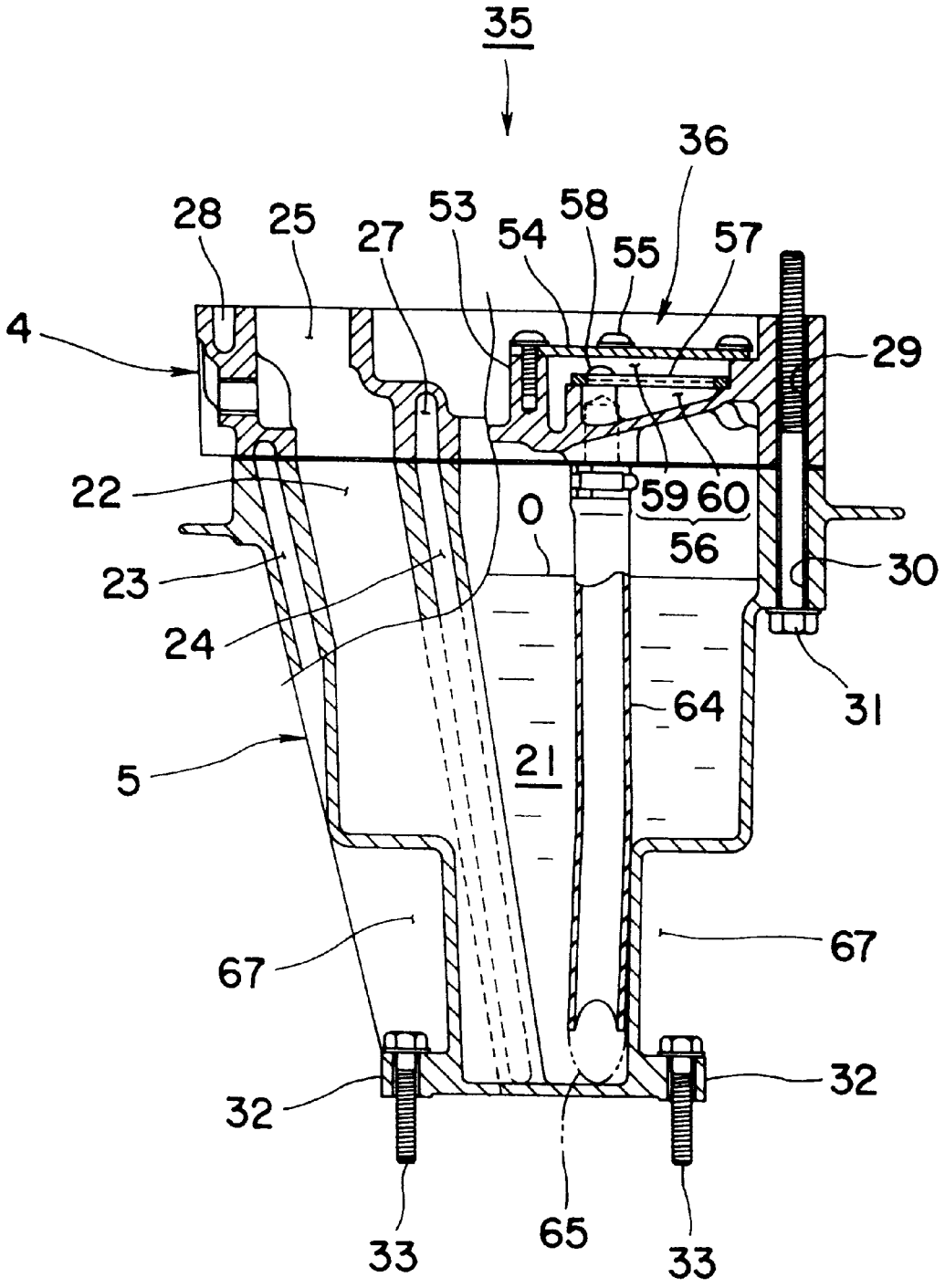
FIG. 3 is a vertical sectional view taken along the line III—III shown in FIG. 2.

As shown in FIG. 3, a plurality of fixing-bolt insertion holes 29 and 30 are formed in a portion around the oil pump case 4 and a portion around the upper portion of the oil pan 5. A fixing bolt 31 inserted, from a lower position, into the fixing-bolt insertion hole 30 of the oil pan 5 passes through a fixing-bolt insertion hole 29 of the oil pump case 4 so as to be fixed to the engine 2. Fixing bolts 33 inserted, from an upper position, into fixed flanges 32 formed on the right and left sides of the lower portion of the oil pan 5 are fixed to the upper portion of the drive housing 6. As a result, the engine 2, the oil pump case 4, the oil pan 5 and the drive housing 6 are integrally secured to one another.

A lubricating apparatus 35 according to the present invention strains the oil O accumulated in the oil accumulating tank 21 of the oil pan 5 by an oil strainer section 36 so as to cause the oil pump 37 to supply the oil O to the inside portion of the engine 2. The structure of the lubricating apparatus 35 will be described hereunder.

Figure 2:
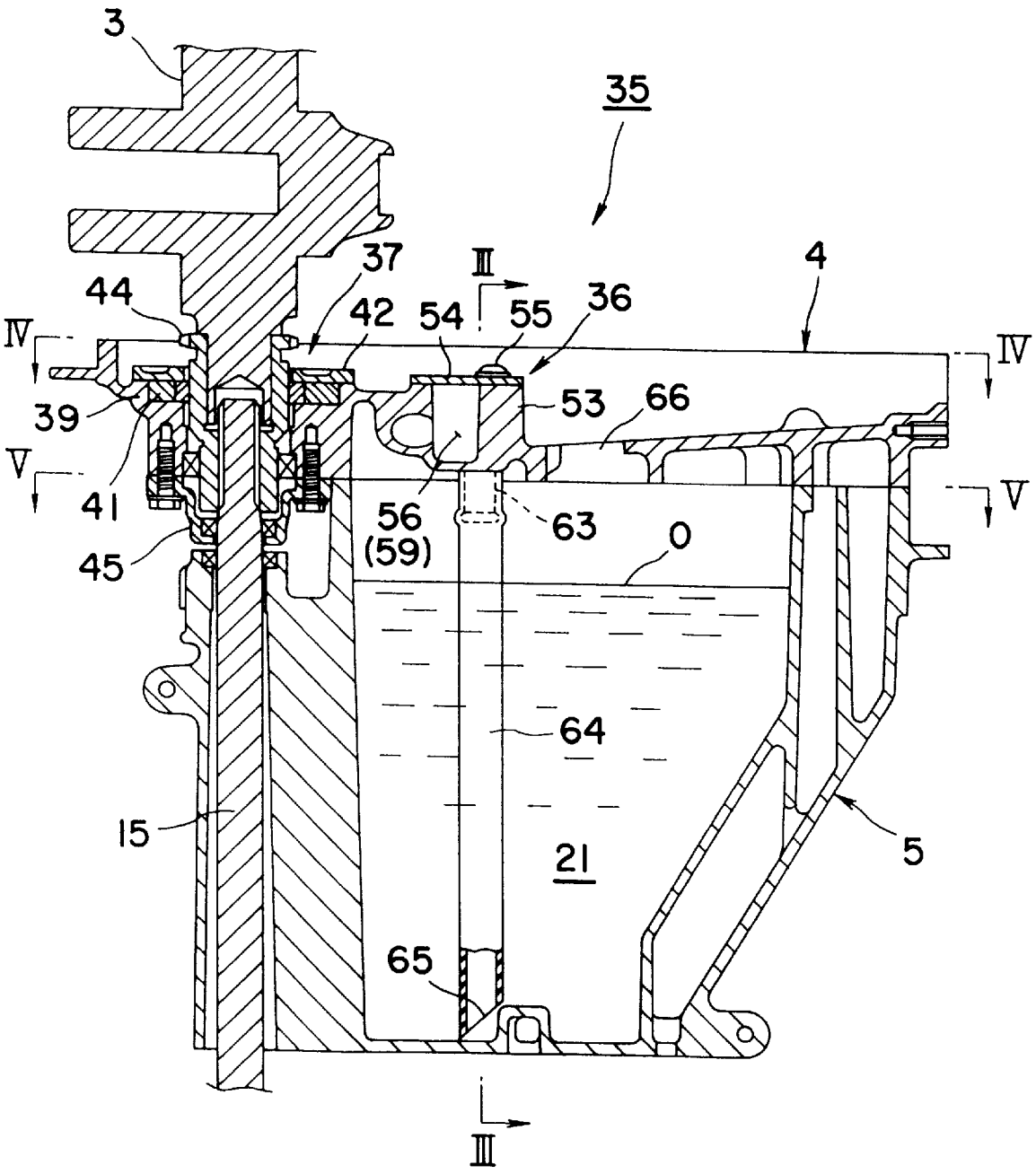
FIG. 2 is a partially-enlarged vertical cross sectional view showing an oil pump case, an oil pan and the lubricating apparatus according to an embodiment of the present invention.

An oil pump 37 is a trochoid pump which is disposed adjacent to a front most portion of the upper surface of the oil pump case 4. As shown in FIG. 2, a pump housing 39 is formed integrally with a portion adjacent to the front portion of the upper surface of the oil pump case 4. A pump rotor 41 is accommodated in a circular rotor chamber 40 (see FIG. 4) formed in the pump housing 39. A pump cover 42 is secured to the upper surface of the pump housing 39 with six screws 43.

A joint member 44 for establishing the connection between the crank shaft 3 and the drive shaft 15 penetrates the pump housing 39, the pump rotor 41 and the pump cover 42. The pump rotor 41 is rotatively and integrally joined to the joint member 44. Therefore, when the joint member 44, that is, the crank shaft 3 is rotated, the pump rotor 41 is operated. Further, it is to be noted that a portion in which the joint member 44 projects over the lower surface of the oil pump case 4 is provided with a seal cover 45 joined and secured to that portion mentioned above.

Figure 4:
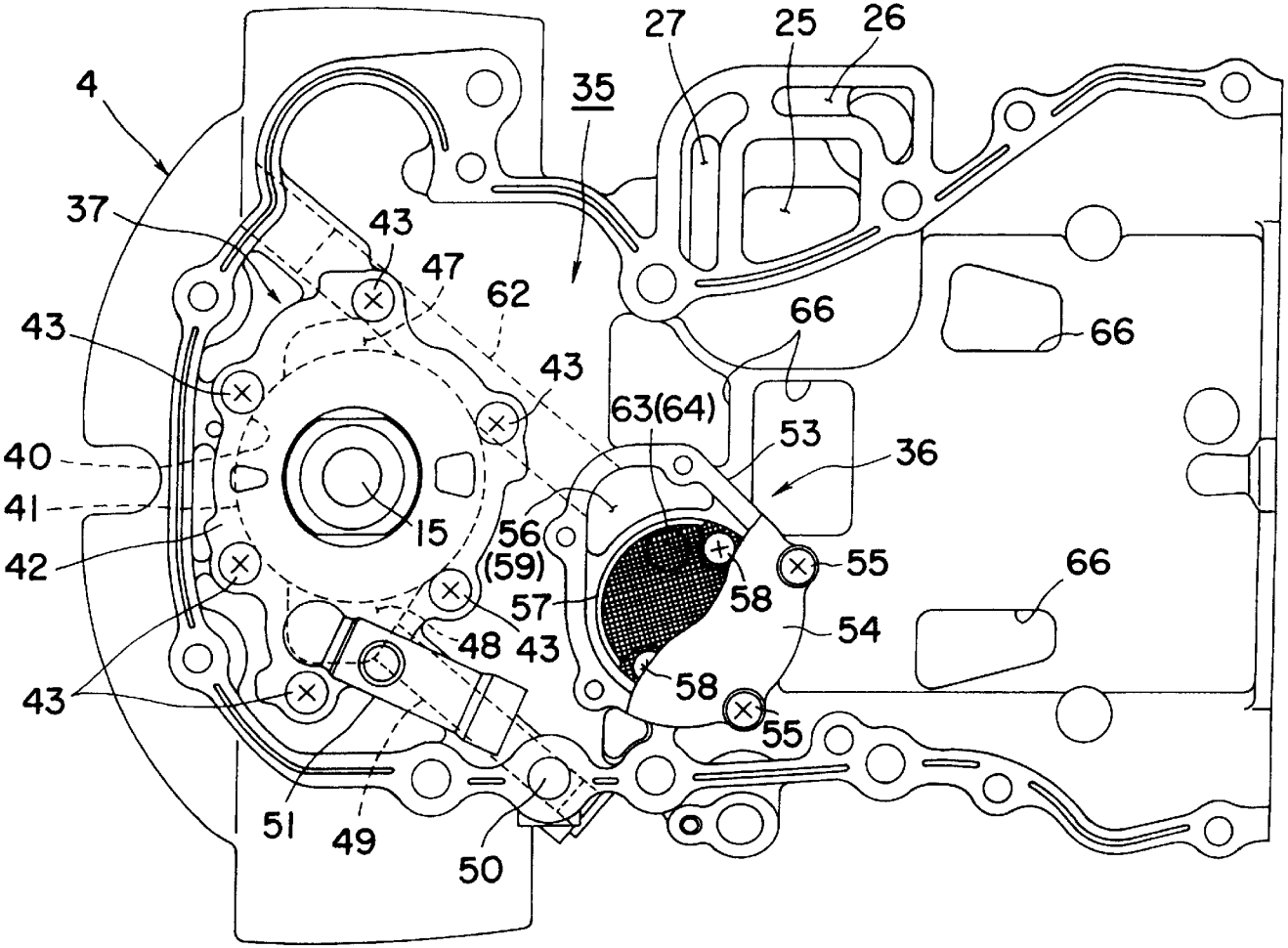
FIG. 4 is a plan view viewed from the line IV—IV shown in FIG. 2 and illustrating an oil pump case.
Figure 5:
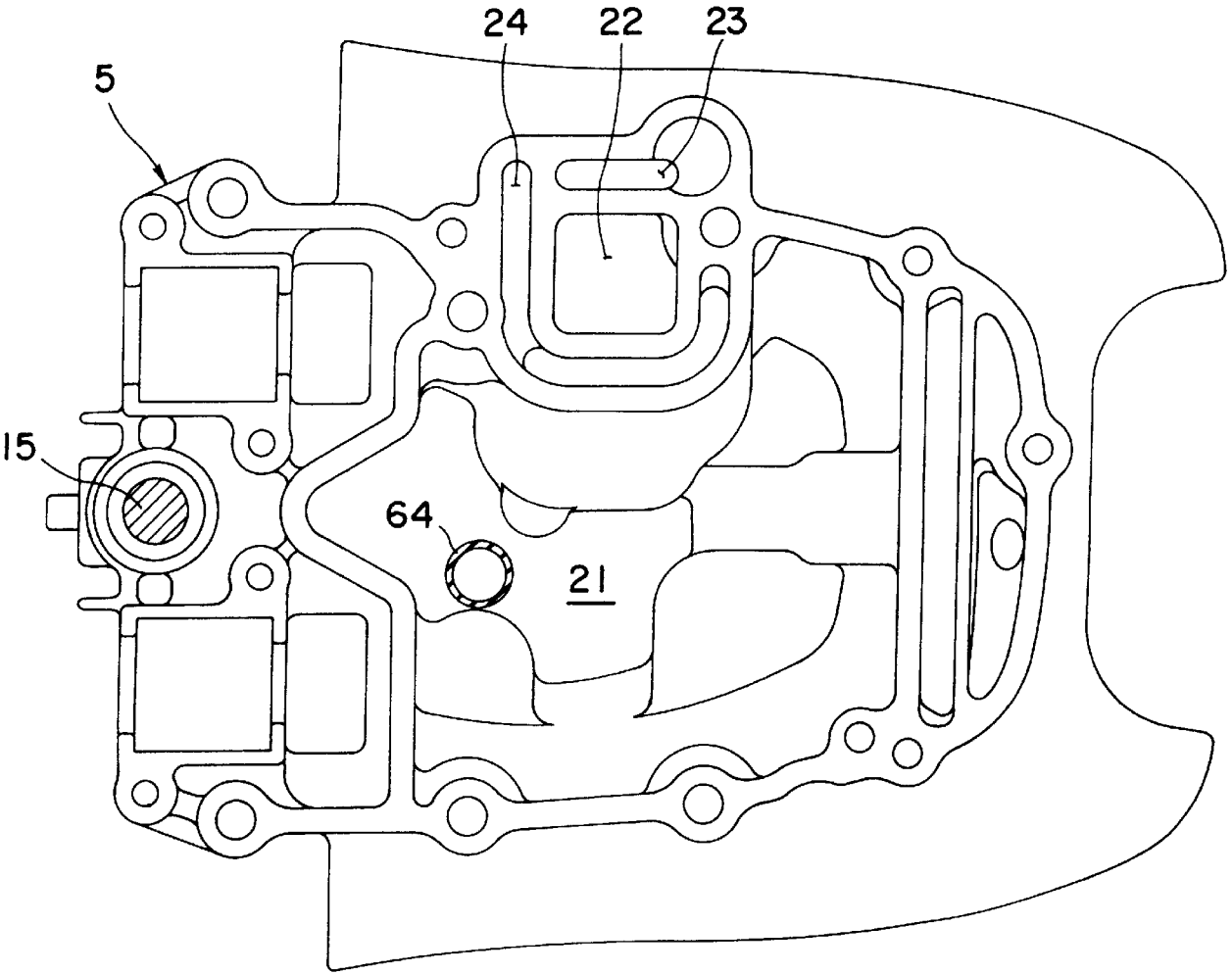
FIG. 5 is a plan view viewed from the line V—V shown in FIG. 2 and illustrating the oil pan.

As shown in FIG. 4, the pump housing 39 has a suction port 47 and a discharge port 48 formed across the rotor chamber 40. The discharge port 48 is connected to an oil gallery 50 through an oil passage 49. The oil gallery 50 is disposed to be connected to a main gallery (not shown) after the engine 2 and the oil pump case 4 have been joined to each other. The pump cover 42 is provided with a relief valve 51 disposed at a position corresponding to the discharge port 48.

On the other hand, the oil strainer section 36 is disposed at a position adjacent to an intermediate position of the upper surface of the oil pump case 4. The oil strainer section 36 is provided with a strainer cover 54 which is, with five screws 55, secured to the upper surface of a strainer housing 53 formed integrally with the oil pump case 4. Moreover, a net-shape oil strainer 57 is, with two screws 58, secured to the inside portion of a strainer chamber 56 formed in the strainer cover 54. As shown in FIG. 3, the oil strainer 57 has the strainer chamber 56 which is divided into an upper clean side 59 and a lower dirty side 60.

The clean side 59 of the strainer chamber 56 is connected to a suction port 47 of the oil pump 37 through an oil passage 62 formed in the oil pump case 4. On the other hand, a suction union 63 (see FIG. 2) connected to the dirty side 60 is provided for the lower surface of the oil pump case 4. An oil suction pipe 64 connected to the suction union 63 extends to the bottom of the oil accumulating tank 21 of the oil pan 5. The oil suction pipe 64 is a hose made of rubber or soft resin material having oil and heat resistances. A lower opening 65 of the oil suction pipe 64 is cut obliquely or diagonally. A plurality of oil return holes 66 in the form of through holes are provided for the oil pump case 4.

When the engine 2 of the outboard motor 1 is rotated, the lubricating apparatus 35 structured as described above is operated such that the oil pump 37 is operated owning to the rotation of the crank shaft 3 (the joint member 44). Therefore, the oil O accumulated in the oil accumulating tank 21 of the oil pan 5 is sucked from the oil suction pipe 64 into the dirty side 60 in the strainer chamber 56. Then, the oil O passes through the net-shape oil strainer 57 so as to flow into the clean side 59. At this time, impurities, such as metal dust, contained in the oil O, are strained by the oil strainer 57 so as to be left in the dirty side 60.

Clean oil allowed to flow into the clean side 59 passes through the oil passage 62 so as to flow into the suction port 47 of the oil pump 37. Then, clean oil flows into the discharge port 48 by the operation of the pump rotor 41. Then, oil passes through the oil passage 49 and the oil gallery 50 so as to be supplied to the inside portion (the main gallery) of the engine 2 to lubricate the engine 2. The oil which has lubricated the engine 2 flows downward to the upper surface of the oil pump case 4. Then, the oil is returned to the oil accumulating tank 21 of the oil pan 5 through the oil return hole 66 of the oil pump case 4.

If the pressure of the oil discharged from the oil pump 37 is excessively high, the relief valve 51 is closed to inhibit the supply of a portion of the oil to the engine 2. In this case, that portion of the oil is returned to the oil accumulating tank 21. Thus, the discharge pressure of the oil can be adjusted to be an appropriate level.

The lubricating apparatus 35 structured as described above is formed such that the oil pump 37 and the oil strainer section 36 are provided for the oil pump case 4 which is a structural member disposed above the oil pan 5. Moreover, the oil suction pipe 64 extends from the oil strainer section 36 to the bottom of the oil accumulating tank 21. Therefore, the oil strainer section 36 can be provided without enlarging the area of the bottom of the oil accumulating tank 21 as has been required for the conventional structure.

The above structure is effective for a case where the size of the oil pan of, for example, an engine for an outboard motor must be reduced downwards. Moreover, freedom in designing the oil pan 5 can be widened. Since the necessity of providing the oil strainer section for the oil pan 5 can be eliminated, the internal structure of the oil pan 5 can considerably be simplified.

Since the oil strainer section 36 does not collide with the oil pan 5 when the oil pan 5 is mounted or removed, the oil strainer section 36 can be protected from breakage. Since a great clearance 67 (see FIG. 3) can be provided for a portion above the fixed flange 32 formed in the lower portion of the oil pan 5, the fixing bolt 33 can easily be inserted into the fixed flange 32. As a result, the oil pan 5 and the drive housing 6 can easily be joined to each other.

Furthermore, the lubricating apparatus 35 has the structure that the pump cover 42 covering the oil pump 37 and the strainer cover 54 covering the oil strainer section 36 are provided for the same side (the upper portion) of the oil pump case 4. Therefore, when the engine 2 is removed, the pump cover 42 and the strainer cover 54 can be easily removed so that simultaneous maintenance of the oil pump 37 and the oil strainer section 36 can be performed. Therefore, maintenance of the lubricating apparatus 35 can significantly easily be done.

Still furthermore, since the lower opening 65 of the oil suction pipe 64, which extends downward from the oil strainer section 36 to reach the bottom of the oil accumulating tank 21, is obliquely cut, the area of the lower opening 65 can be enlarged. Thus, the oil suction pipe 64 is not easily clogged, and as a result, the oil can satisfactorily smoothly be sucked into the oil pump 37.

Since the oil suction pipe 64 is formed of a flexible hose, the oil pump case 4 can easily be inserted into the oil accumulating tank 21 with no interference of the oil suction pipe 64 with each portion of the oil pan 5 when the oil pan 5 is mounted on the lower portion of the oil pump case 4, thus the oil pan 5 being easily mounted to the engine.

Although the foregoing embodiment has the structure that the oil strainer section 36 and the oil pump 37 are provided for the upper surface of the oil pump case 4, the oil strainer section 36 and the oil pump 37 may be provided for the lower surface of the oil pump case 4. The oil strainer section and the oil pump may be provided for a structural member except for the oil pump case 4 disposed above the oil pan 5, for example, the engine 2 (in a case of an outboard motor in which, for example, the oil pan is directly joined to the lower surface of the engine).

The above-mentioned structure can widely be employed as the lubricating apparatus for an automobile or a motorcycle.

Figure 6:
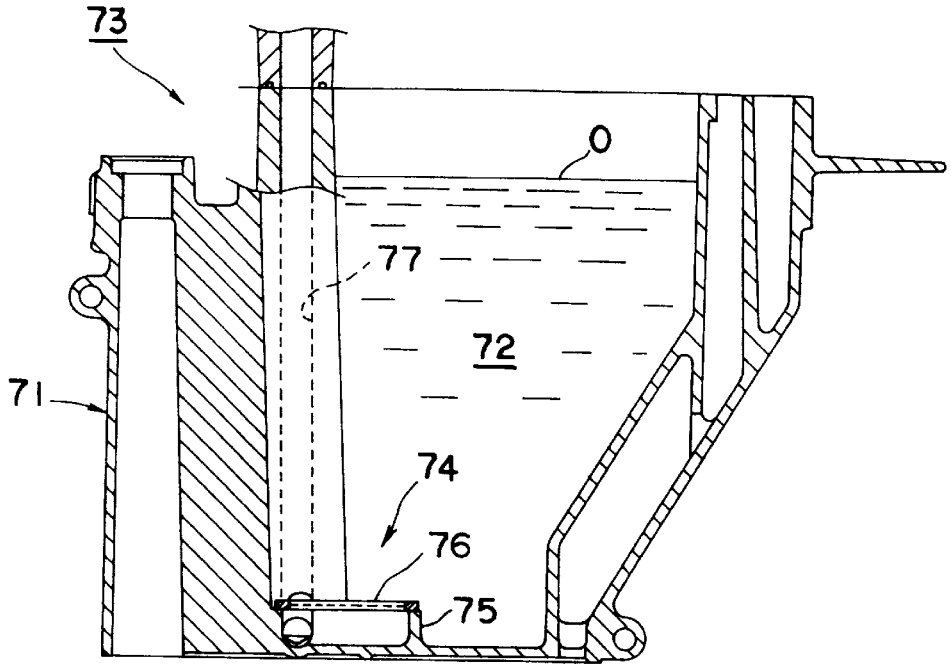
FIG. 6 is a vertical cross sectional view showing an example in which another embodiment of the lubricating apparatus according to the present invention is applied to an engine of an outboard motor.

FIG. 6 is a vertical cross sectional view showing an example in which another embodiment of the lubricating apparatus according to the present invention is applied to an engine for an outboard motor. As like in the case of the outboard motor mentioned in the former embodiment, an oil accumulating tank 72 is formed in an oil pan 71 disposed in the lower portion of an engine (not shown) so that the oil O is accumulated in the oil accumulating tank 72. A lubricating apparatus 73 is provided for the oil pan 71.

The lubricating apparatus 73 includes an oil strainer section 74 provided for the bottom of the oil accumulating tank 72. The oil strainer section 74 is provided with a strainer housing 75 formed integrally with the bottom of the oil accumulating tank 72 and having an enclosure shape, a net-shape oil strainer 76 provided for the upper opening of the strainer housing 75, and an oil passage 77 extending vertically in the oil pan 71. The oil passage 77 establishes the communication between an oil pump (not shown) provided for the engine portion and the inside portion of the strainer housing 75.

When the oil pump of the lubricating apparatus 73 is operated, the oil O accumulated in the oil accumulating tank 72 is strained by the oil strainer 76. Then, the oil O is introduced into the strainer housing 75 and then flows upward in the oil passage 77 so as to be sucked by the oil pump, thereby to supply the oil O to the engine. The lubricating apparatus 73 structured as described above includes the oil strainer section 74 formed integrally with the bottom of the oil accumulating tank 72.

Figure 7:
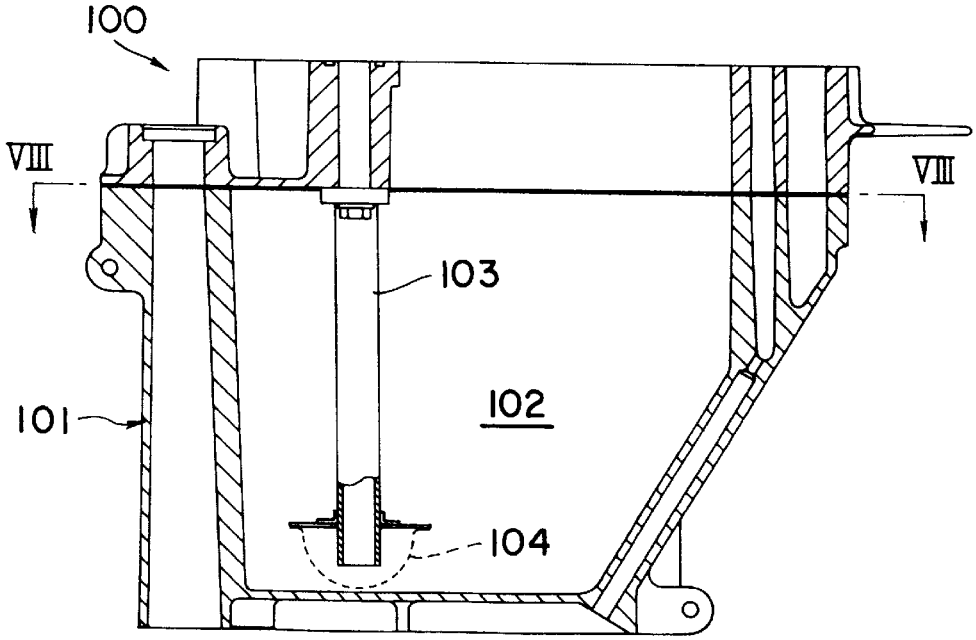
FIG. 7 PRIOR ART
FIG. 7 is a vertical sectional view showing a conventional lubricating apparatus.
Figure 8:
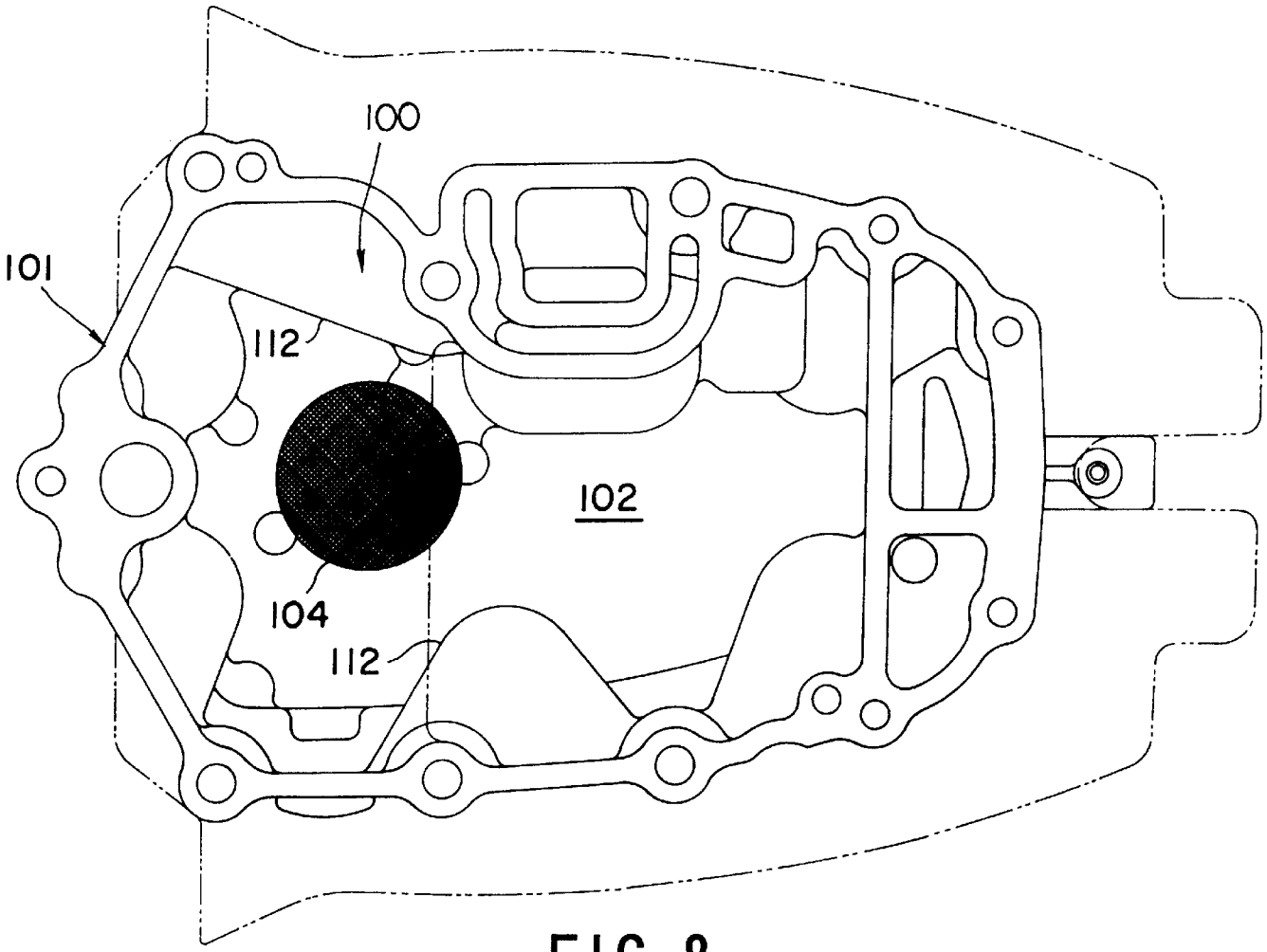
FIG. 8 PRIOR ART
FIG. 8 is a plan view viewed from the line VIII—VIII shown in FIG. 7 and illustrating an oil pan.

A conventional lubricating apparatus 100 structured as shown in FIG. 7 must have a clearance between the inner wall of the oil pan and the strainer section. On the other hand, the lubricating apparatus 73 according to the present invention is not required to have such clearance. Therefore, the oil strainer section 74 can be disposed without enlarging the area of the bottom of the oil accumulating tank 72. Therefore, freedom in designing the oil pan 71 can be widened. Moreover, breakage of the oil strainer section 74, which may occur at a time when the oil pan 71 is mounted or removed, can effectively be prevented.

In addition to the above advantageous effects, according to the present invention, the maintenance of the oil strainer section and the oil pan can easily be performed. Moreover, the oil pan can easily be mounted while a satisfactory state of sucking oil into the oil pump being maintained.

It is to be noted that the present invention is not limited to the described embodiments and many other changes or modifications may be made without departing from the scope of the appended claims.

What is claimed is:

1. A lubricating apparatus for an engine comprising:

an oil pan disposed in a lower portion of an engine in a mounted state thereof and provided with an oil accumulating tank;

an oil strainer for straining an oil accumulated in the oil accumulating tank;

an oil pump for supplying strained oil to an inside portion of the engine, said oil strainer and said oil pump being mounted to a structural member disposed above the oil pan so as to be connected to each other; and an oil suction pipe extending from said oil strainer to a bottom portion of the oil accumulating tank.

2. A lubricating apparatus for an engine according to claim 1, wherein said oil strainer includes a cover therefor and said oil pump includes a cover therefor, said covers of the oil strainer and the oil pump being provided for a same side of said structural member to which said oil strainer and said oil pump are mounted.

3. A lubricating apparatus for an engine according to claim 1, wherein said oil suction pipe has a lower opened end which is obliquely cut.

4. A lubricating apparatus for an engine according to claim 1, wherein said oil suction pipe is formed of a flexible hose member.

5. A lubricating apparatus for an engine according to claim 1, wherein said structural member is a pump case in which the oil pump is accommodated.

6. A lubricating apparatus for an engine according to claim 5, wherein said oil strainer is disposed in an oil strainer chamber so as to divide the oil strainer chamber into an upper clean side and a lower dirty side, said upper clean side being communicated with a suction port of the oil pump through an oil passage formed in the oil pump case and said lower dirty side being communicated with the oil suction pipe.

7. A lubricating apparatus for an engine according to claim 1, wherein said oil strainer has a net-shaped structure.

* * * * *